United States Patent [19]

Yamazawa

[11] 4,437,423

[45] Mar. 20, 1984

[54] THREAD TRIMMING DEVICE FOR A SEWING MACHINE

[75] Inventor: Masayuki Yamazawa, Aichi, Japan

[73] Assignee: Aisin Seiki Kabushiki Kaisha, Aichi, Japan

[21] Appl. No.: 351,210

[22] Filed: Feb. 22, 1982

[30] Foreign Application Priority Data

Feb. 26, 1981 [JP] Japan ..... 56-28149

[51] Int. Cl.[3] ..... D05B 65/02

[52] U.S. Cl. ..... 112/292

[58] Field of Search ..... 112/291, 292

[56] References Cited

U.S. PATENT DOCUMENTS 3,141,432 7/1964 Reeber et al. ..... 112/292
3,889,615 6/1975 Uozake et al. ..... 112/292
3,921,554 11/1975 Uozaki et al. ..... 112/292

FOREIGN PATENT DOCUMENTS 1417320 12/1975 United Kingdom ..... 112/291

*Primary Examiner*—Louis Rimrodt
*Assistant Examiner*—Andrew M. Falik
*Attorney, Agent, or Firm*—Oblon, Fisher, Spivak, McClelland & Maier

[57] ABSTRACT

A thread trimming device comprises a first ratchet disposed on a first shaft having a first partial gear, a first cam surface, a first radial projection, and blank surfaces on its periphery. A second ratchet disposed on a second shaft has a second partial gear, a second radial projection, and a second cam surface on its periphery. A stationary blade is secured to a framework. A pivotably movable blade is connected to the second shaft. A solenoid moves the second ratchet along the second shaft such that, upon actuation of the solenoid, the toothed portion of the first and second partial gears are engaged with each other to rotate the movable blade to an operable position relative to the stationary blade. Thereafter the first cam surface comes into contact with the second partial gear to slowly rotate the movable blade to cooperate with the stationary blade to perform the thread trimming operation. Afterwards, the first radial projection comes into sliding contact with the second radial projection and the second cam surface to rotate the second ratchet in the reverse direction after the termination of the thread trimming operation.

2 Claims, 13 Drawing Figures

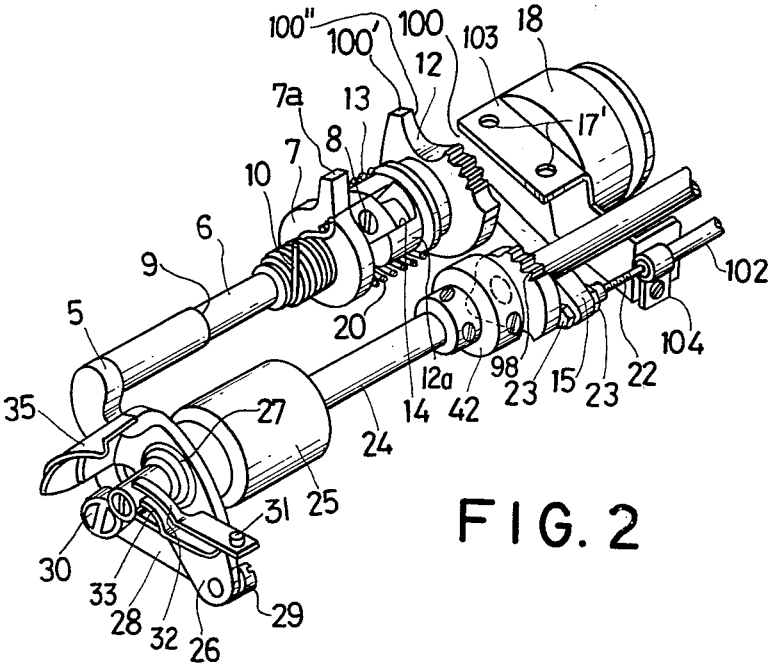
FIG. 2
FIG. 3
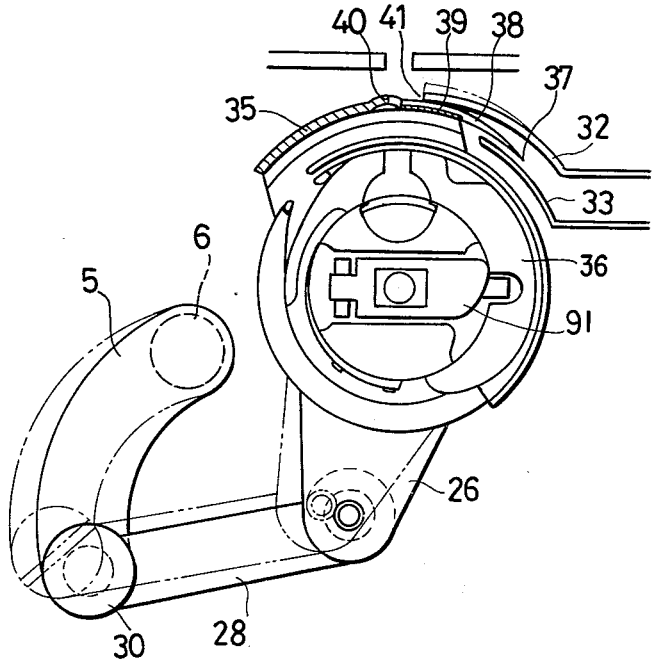

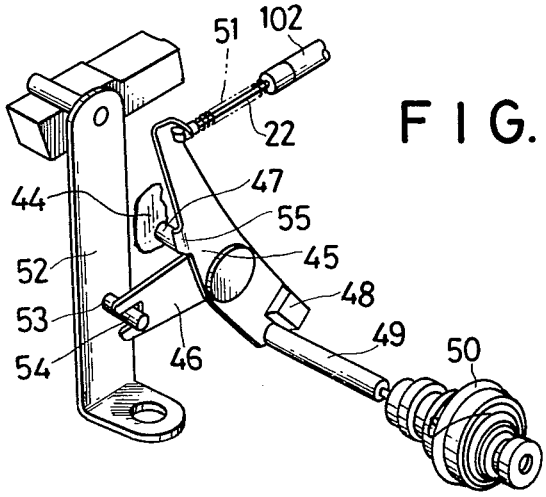
FIG. 4
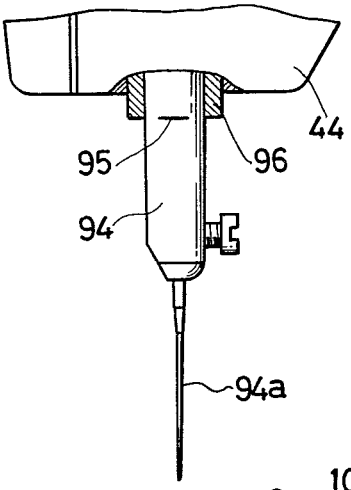
FIG. 5
FIG. 6
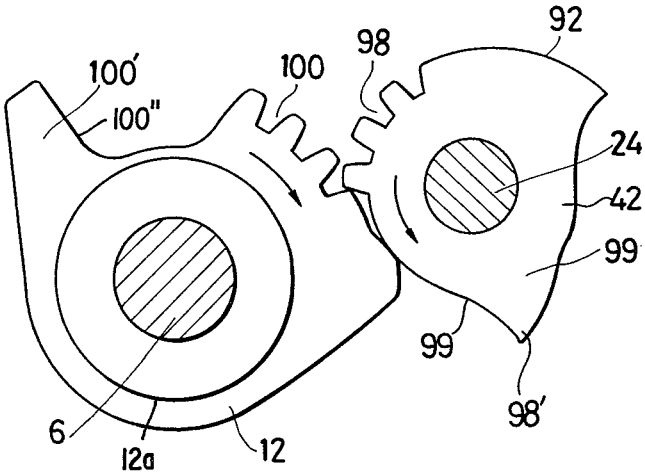

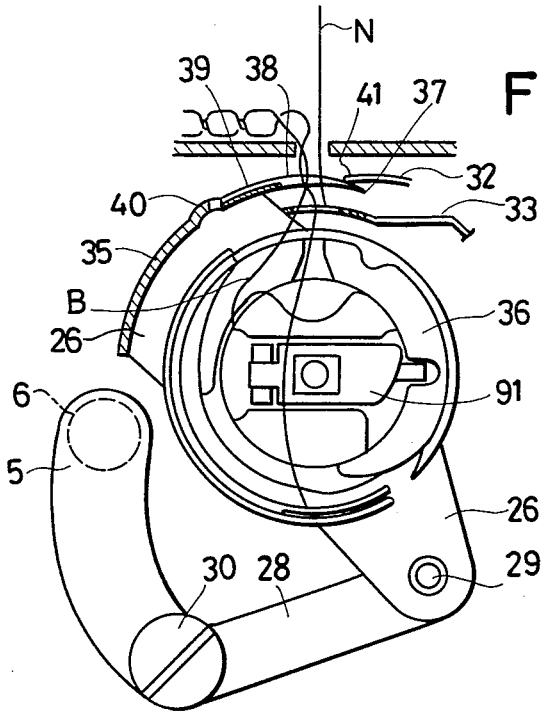
FIG. 7
FIG. 8
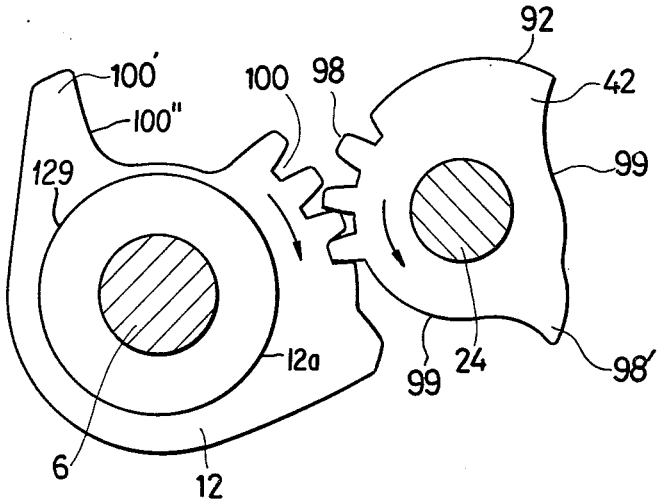

THREAD TRIMMING DEVICE FOR A SEWING MACHINE

BACKGROUND OF THE INVENTION

1. Field of the Invention

This invention relates generally to industrial straight lock stitch sewing machines, especially to a thread trimming device for a sewing machine in which an upper thread and a lower thread are subject to being caught by a thread catcher and trimmed by cutter blades after the termination of the sewing operation.

2. Description of the Prior Art

A thread trimming device of this class is disclosed, for example, in U.S. Pat. No. 3,921,554, patented Nov. 25, 1975 in which a first partial gear fixedly secured to a first shaft connected to a hook shaft meshes with a second partial gear disposed on a second shaft which is operably connected to a thread catcher through a clutch against the action of a spring to move the second shaft for thread trimming operation. However, high compressive pressure is applied between a holder of the thread catcher and a metal bearing for the shaft by virtue of trimming pressure applied when trimming the thread, thereby precluding smooth sliding of the second partial gear during the trimming operation and further swivel of the thread catcher and the holder thereof returning to the original position after the termination of the thread trimming operation.

SUMMARY OF THE INVENTION

It is a primary object of the present invention to provide a thread trimming device for a sewing machine in which the swivel of the thread catcher and the holder thereof returning to the original position after the termination of the thread trimming operation is ensured.

According to the present invention, there is provided a thread trimming device which achieves the foregoing objective. This device includes a first shaft rotatably driven by a main shaft of the sewing machine. A first ratchet means having a first partial gear, a first cam surface, a first radial projection, and blank surfaces formed on both sides of the first radial projection on the periphery thereof is disposed on the first shaft and rotatable therewith. A stationary blade means is fixedly secured to the framework of the sewing machine. A second shaft is disposed parallel to the first shaft. Pivotably movable blade means are connected to the second shaft. A second ratchet means having a second partial gear, radial projection, and a second cam surface therebetween on the periphery thereof is disposed on the second shaft and is axially movable relative thereto so as to selectively engage the first ratchet means. Electrically operable means are provided for moving the second ratchet means along the second shaft so as to engage the first ratchet means. Upon actuation of the electrically operable means, the toothed portions of the first and second partial gears are engaged with each other, causing rotation of the second shaft. Rotation of the second shaft causes pivotal movement of the movable blade means to an operable position relative to the stationary blade means. Thereafter, the first cam surface comes into sliding contact with the second partial gear. Interaction of the first cam surface and the second partial gear slowly rotates the second movable blade means to cooperate with the stationary blade means to perform the thread trimming operation. Next, the first radial projection comes into sliding contact with the second radial projection and the second cam surface to rotate the second ratchet means in a direction reverse to the direction of the thread trimming job after the termination of the thread trimming operation.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

Various other objects, features and attendant advantages of the present invention will be more fully appreciated as the same become better understood from the following detailed description when considered in connection with the accompanying drawings in which like reference characters designate like or corresponding parts through the several views and wherein:

FIG. 2 is a perspective view of the essential parts of the thread cutting device according to the invention.

FIG. 3 is a front elevation of the thread cutting device when seen from the front side of the machine bed.

FIG. 4 is perspective view of a tension release mechanism cooperating with the thread cutting device.

FIG. 5 is partial sectional elevation of a needle bar together with a part of the machine arm, specifically illustrating a timing mark provided on the needle bar.

FIG. 6 is an enlarged detail side view of a pair of partial gears employed in the thread cutting device shown at a timing in coincidence of that of the needle bar shown in FIG. 5.

FIG. 7 is a partial sectional front view of a thread catcher cooperating with a conventional rotary hook, the timing being such that the thread catcher is beginning to catch the sewing thread.

FIG. 8 is a view similar to FIG. 6 wherein, however, the timing is the same as in FIG. 7.

DESCRIPTION OF THE PREFERRED EMBODIMENT

In the following, a preferred embodiment of the invention will be described in detail by reference to the accompanying drawings.

Figure 1:
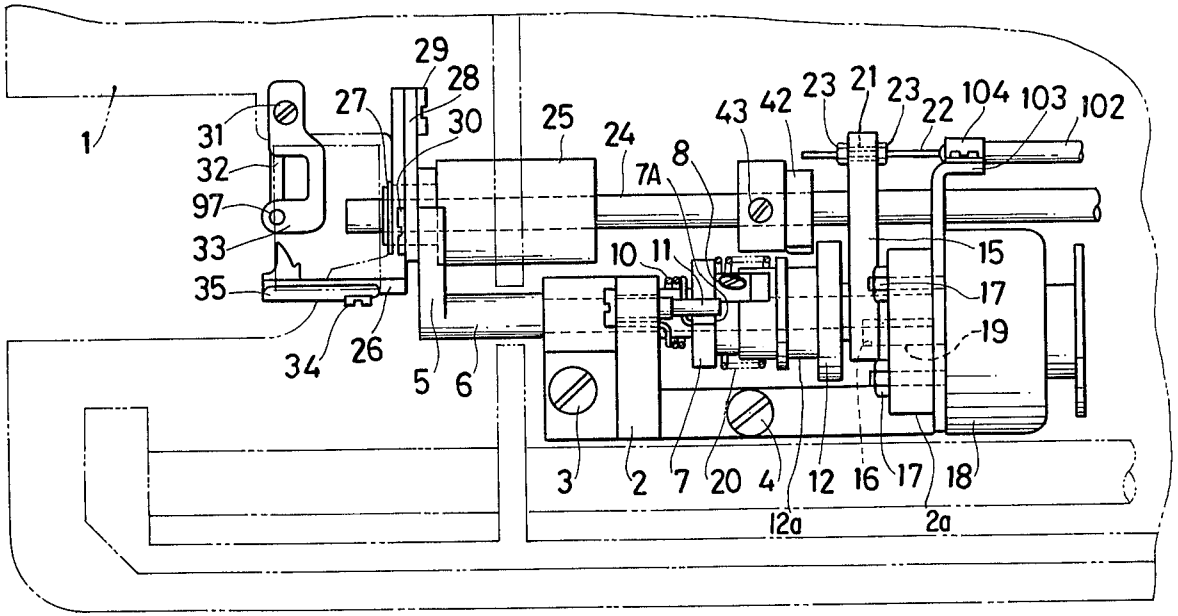
FIG. 1 is an inverted plan view of essential parts of the thread cutting device according to the present invention from the bottom side of the machine bed.

In FIGS. 1–3, numeral 1 denotes schematically and partly in phantom manner a machine bed, a mounting frame 2 being fixedly attached on a lower surface of the bed by means of set screws 3 and 4. A shaft 6 having a rigid operating lever portion 5 is mounted rotatably on the frame 2. The shaft 6 is further provided rigidly with an enlarged flange 7 attached thereto by means of a set screw 8. As seen, especially from FIG. 2, the shaft 6 is formed with a shoulder 9 for the prevention of occasional axial shift of the shaft 6 in one direction. The flange 7 serves to prevent axial shift of the shaft 6 in the other direction.

A coil spring 10 is mounted on the shaft 6 between a part of the frame 2 and a radial projection 7*a* of the flange 7. As will be recalled, the flange 7 is fixed to the shaft 6, and the coil spring 10 accordingly does not have an axial biasing function. Instead, it biases the shaft 6 in the counterclockwise direction in FIG. 2. When the thread trimming device is in its off-service position (shown in FIG. 1), the coil spring 10 keeps the radial projection 7*a* in engagement with a stationary stop 11 mounted on the frame 2. The stop 11 is fixedly positioned by being threaded through a portion of the frame 2.

Numeral 12 represents a follower partial gear toothed only at 100 and mounted loosely on the shaft 6. The follower partial gear 12 has a radial projection 100′ and a cam portion 100″ between the teeth 100 and the radial projection 100′ as shown in FIG. 6. The follower partial gear 12 also has an axially projecting boss 12*a* which in turn has an axial slot 14 formed in its periphery. The axial slot 14 slidably receives an axial projection 13 which projects rigidly from the solid flange 7. Follower partial gear 12 is slidable axially on the shaft 6, but its rotation is made in unison therewith by virtue of the fixed mounting of the flange 7 on the shaft 6.

Arm member 15 is mounted loosely on the shaft 6. The loose mounting of the arm member 15 permits it both to move axially on the shaft 6 and to rotate relative to the shaft 6. The arm member 15 has a recess 16 which receives the tip end of plunger 19 of thread-cutter solenoid 18. Thread-cutter solenoid 18 is fixedly mounted on a part 2*a* of the frame 2 by means of a plurality of horizontal set screws 17. A stationary member 103 is fixed on the upper surface of the part 2*a* of the frame 2 by vertical set screws (not shown) which pass through holes 17′ in stationary member 103. Therefore, the arm member 15 normally cannot rotate with the shaft 6 when the latter is caused to rotate.

It will be seen from the foregoing that, when solenoid 18 is energized by supply of electric current thereto from a current source (not shown) for the execution of a thread-cutting job, plunger 19 is caused to advance leftwards in FIG. 1. When the plunger 19 advances leftwards in FIG. 1, it pushes the arm member 15 and the partial gear 12 in the same direction against the action of a coil spring 20 provided between the partial gear 12 and the flange 17.

Numeral 22 represents a thread-release cable passing through a small hole 21 formed in one end of the arm member 15 and fixedly attached thereto by a pair of fixing elements 23. A flexible cable sheath 102 slidably guides the thread-release cable 22 and is attached fixedly as its one end to the stationary 103 by means of a clip 104.

Number 24 represents part of a conventional hook shaft which is supported rotatably at the one end shown by a bearing 25. The bearing 25 is press fit in position into the bed 1, as shown in FIG. 1.

A pivotable holder 26 is provided in close proximity to the left end of the bearing 25, FIG. 1. Leftward axial movement of the pivotable holder 26 is prevented by a stop ring 27 mounted on the hook shaft 24. The holder 26 and the operating lever portion 5 are pivotably connected to each other by a link member 28 and stepped screws 29 and 30.

Figure 14:
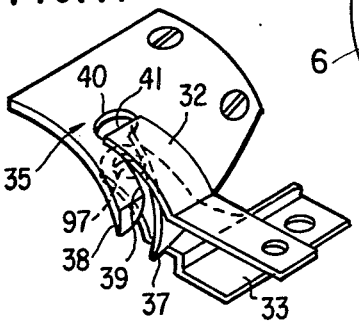
FIG. 14 is an isometric drawing of the thread catcher.

A stationary cutter blade 32 and a thread guide plate 33 are fixedly attached to the bed 1 by means of a set screw 31. The stationary cutter blade 32 is arranged in opposition to a thread catcher 35 (shown in FIG. 14) which is fixedly attached to the pivotable holder 26 by a set screw 34. The stationary cutting edge 41 formed on the tip end of the stationary cutter blade 32 and the movable cutting edge 40 formed on thread catcher 35 can be brought into a shearing relationship for performing a thread cutting job, as will be described later more fully.

The free end portion of thread guide plate 33 has an arc-shape in its side view, the arc being designed and arranged concentrically with a conventional rotary hook 36. The thread guide plate 33 is arranged to occupy an intermediate position when seen in the radial direction of the rotary hook, as most clearly seen from FIGURE &. The thread guide plate 33 is further provided with an opening 97 adapted for passage of the sewing thread so as to keep the sewing thread in coincidence with the center of the needle.

The thread catcher 35 comprises as its effective portion an arc-shaped portion made concentric to the rotary hook 36. The thread catcher 35 also has a pointed end portion 37. Behind the pointed end portion 37 is a thread-engaging portion 38, and behind the thread-engaging portion 38 is a longitudinally grooved portion 39 terminating in the movable cutting edge 40. The movable cutting edge 40 is adapted for cooperating with the stationary cutting edge 41 formed on the tip end of the stationary cutting blade 32 for performing a thread cutting job, as will be more fully described hereinafter.

A driving partial gear 42 is attached fixedly to the hook shaft 24 by means of a set screw 43. The driving partial gear 42 has drive teeth at 98. In succession to the drive teeth 98, the partial gear 42 has on its outer periphery a cam portion 92 having a gradually increasing radius of curvature. In further succession to the cam portion 92, the partial gear 42 has a radial projection 98′ and blank peripheral surfaces 99, 99 on both sides of the radial projection 98′. The blank peripheral surfaces 99, 99 terminate at the teeth 98 in one direction and at the cam portion 92 in the other direction. The radius of curvature of the blank peripheral surfaces 99, 99 are equal to or less than the radius of the bottom circle of the drive teeth 98.

The driving partial gear 42 rotates in idle and in unison with the hook shaft 24 during the normal sewing operation of the machine. However, when the solenoid 18 is energized for initiating a thread cutting job, the follower partial gear 12 is caused to slide on the shaft 6 as explained previously so that the follower partial gear 12 is brought into lateral registration with the companion driving partial gear 42. As will be further explained hereinafter, the two partial gears 12 and 42 are adapted for engagement with each other during the rotational movement of the hook shaft 24.

As shown in FIG. 4, a tension-release lever 45 and a pivotable member 46 are both pivotably mounted on a conventional machine arm 44 by means of a common pivot pin 47, although the set position has been omitted from the drawing. Tension release lever 45 is formed with a cam surface 48 which is adapted for acting upon a pin or tension stud 49 when the tension release lever 45 is rotated. When the tension stud 49 is moved, the tension of the upper thread at a thread tension disc unit 50 of a known structure is released, as in the commonly known way.

The cable guide sheath 102 is fixedly attached at one end of the solenoid mounting plate 103 as shown and described hereinbefore in connection with FIG. 1. The opposite end of the cable guide sheath 102 is fixedly attached to the machine arm 44, although not specifically shown. The cable 22 slidable in and along the sheath 102 has its one end fixedly attached to the upper or motion-receiving end of the tension release lever 45 as shown in FIG. 4. A tension spring 51 is connected between the tension release lever 45 and the cable guide sheath 102 (which, as previously mentioned, is attached to the machine arm 44), biasing the tension release lever 45 in the counterclockwise direction in FIG. 4. By the sliding movement of arm member 15 caused by energization of the solenoid 18 in the previously described manner, the tension-release lever 45 is pulled by the cable 22 against the spring action of the tension spring 51 so that the tension release lever 45 is caused to pivot in the clockwise direction in FIG. 4 about the pivot pin 47 for the execution of the tension-releasing job, as was described hereinbefore. On the contrary, when the solenoid 18 is de-energized, the tension in the cable 22 is released, allowing the accumulated energy in the tension spring 51 to pivot the tension release lever 45 in the counterclockwise direction in FIG. 4. When the tension release lever 45 pivots in the counterclockwise direction, the cam surface 48 is disengaged from contact with the motion-receiving end of the pin or tension stud 49.

When a commonly known lifting plate 52 is lifted by means of knee lifter, as an example, the pivotable member 46 is caused to pivot in the clockwise direction in FIG. 4 by virtue of the fork joint between a pin 53 on the lifting plate 56 and a fork 54 on the pivotable member 46. The pivotal motion of the member 46 causes it to push a pointed projection 55 of the thread tension release lever 45, in turn causing the thread tension release lever 45 to pivot in the clockwise direction. As previously described, clockwise rotation of the thread tension release lever 45 releases upper thread tension.

As shown in FIG. 5, a conventional needle bar 94 is disposed in the machine arm 44. The needle bar 94 carries a needle **94*a* and is reciprocated by a crank mechanism (not shown) actuated by the rotation of a conventional upper or arm shaft (not shown). The needle bar 94 is given a timing mark shown at 95 which is selected at a predetermined position on the needle bar 94. In the present case, when the timing mark 95 is brought into coincidence with the lower end of needle bar bearing 96 as shown, the needle bar 94 will occupy a position of about 55 degrees in advance of the upper dead point of the needle bar 94**.

As is commonly known, and although not specifically shown, the thread tension disc unit 50 is mounted on the front side of the machine arm 44 in close proximity to the free end extremity of the machine arm 44.

The general operation of the thread trimming device so far shown and described is as follows.

When the operation for a thread cutting job is started, the trimming solenoid 18 is energized. Accordingly, the plunger 19 operates to push the arm member 15 and the partial gear 12 axially in the previously described manner, bringing the partial gear 12 into registration with its companion partial gear 42 ready for mutual engagement. When the hook shaft 24 rotates to the point where the needle bar 94 is about 55 degrees in advance of its upper dead point, the driven partial gear 42 is brought into engagement with the follower partial gear 12, as shown in FIG. 6. Thus, rotation is transmitted from the driving partial gear 42 to the follower partial gear 12 against the resilient force of the coil spring 10. This motion is further transmitted through flange 7, shaft 6, lever 5 and link member 28 to pivotable holder 26. Thus, the pivotable holder 26 begins to pivot, causing the thread catcher 35 to initiate a thread trimming operation.

Next, the two partial gears 12 and 42 rotate to positions shown in FIG. 8. When the partial gears 12 and 42 are in the positions shown in FIG. 8, the pointed end portion 37 of thread catcher 35 is thrust into the loop of upper thread N formed by the rotary hook 36, as schematically shown in FIG. 7. At the same time, the thread-engaging portion 38 of thread catcher 35 begins to engage thread B extending from a bobbin case 91, housed as is conventional within the rotary hook 36.

Figure 10:
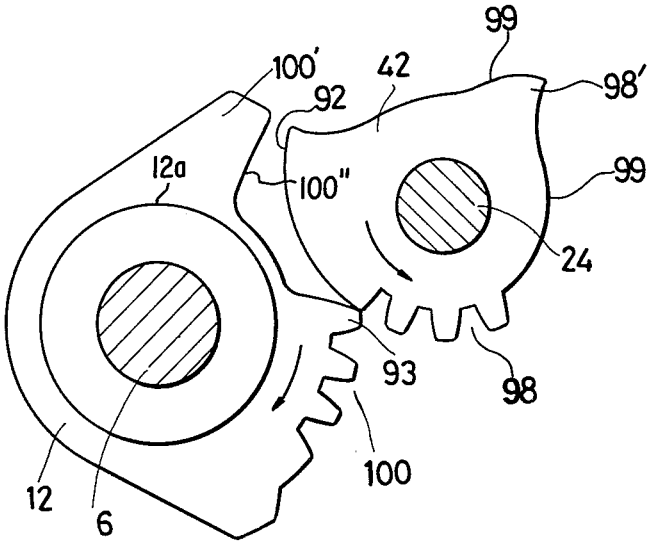
FIG. 10 is a view similar to FIG. 6, wherein, however, the timing corresponds to that in FIG. 9.

At a still further advanced timed phase of the mutually engaging partial gears 12, 42 as shown in FIG. 10, the partial gears 12 and 42 have completed a partial revolution due to the meshing of their gear teeth. At this time, the upper thread N is subjected to an upwardly directed drawing action by a conventional thread take-up lever (not shown). However, the upper thread N is held by the thread-engaging portion 38 of the thread catcher 35, so as to leave a proper end length of the thread N—enough to avoid a slip-out of the thread from the thread eyelet (not shown) of the needle **94*a* at the commencement of the next sewing job. At this stage, the lower thread B, together with a part of the upper thread N which lies close to the sewing material (not shown), runs in and along the groove in the grooved portion 39 of the thread catcher 35. In this position, both threads are spaced in the leftward, or counterclockwise direction from the stationary cutting edge 41 of stationary cutter blade 32. Therefore, a proper length of the lower thread B as necessary for later use after thread trimming and upon initiation of a new sewing job can be drawn out from the bobbin case 91** and preserved in position.

Figure 9:
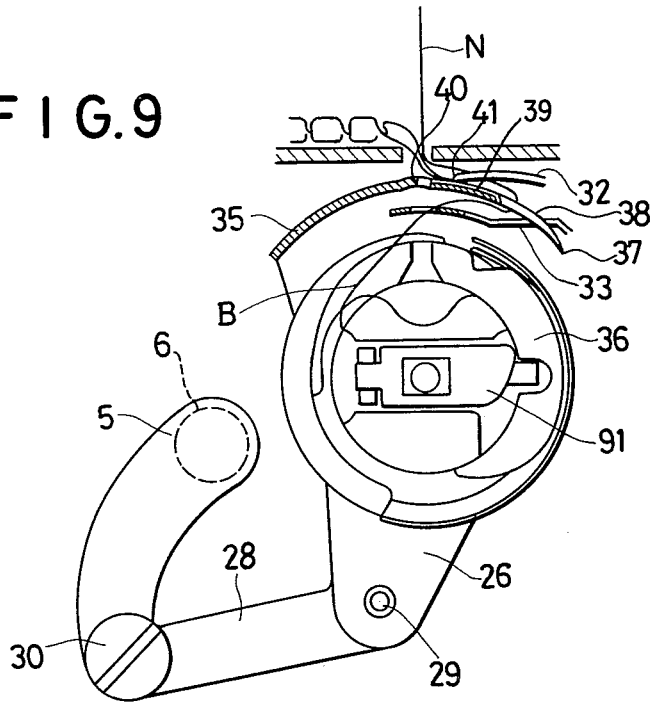
FIG. 9 is a view similar to FIG. 7, wherein, however, the thread catcher has caught the sewing yarn.

As the timing of the operational stage shown in FIGS. 9 and 10 corresponds to 60°–70° in advance of the arrival of the upper dead point of the thread take-up lever, a considerable difficulty will occur due to the imposition of an excess upward pulling of the trimmed upper thread N by the upward movement of the thread take-up lever towards its upper dead point if the upper thread is trimmed directly after the completion of the aforementioned thread catching operation. In fact, the excess upward pulling of the trimmed upper thread N may even cause the thread N to slip off the needle **94*a*, thereby making the next succeeding sewing operation impossible. On the other hand, if the thread catcher 35 is moved over a substantial distance after the execution of the thread catching operation, it is necessary to overcome a considerable amount of resistance provided by the part of the upper thread N extending from its supply source to the thread catcher 35 even if the thread tension at the thread tension disc unit 50** has been released. Even if the upper thread N is not broken unintentionally in this case, the thread trimming device will require a considerably large amount of driving force when operating under these conditions. According to the present invention, these otherwise unavoidable conventional drawbacks can be substantially obviated.

Figure 11:
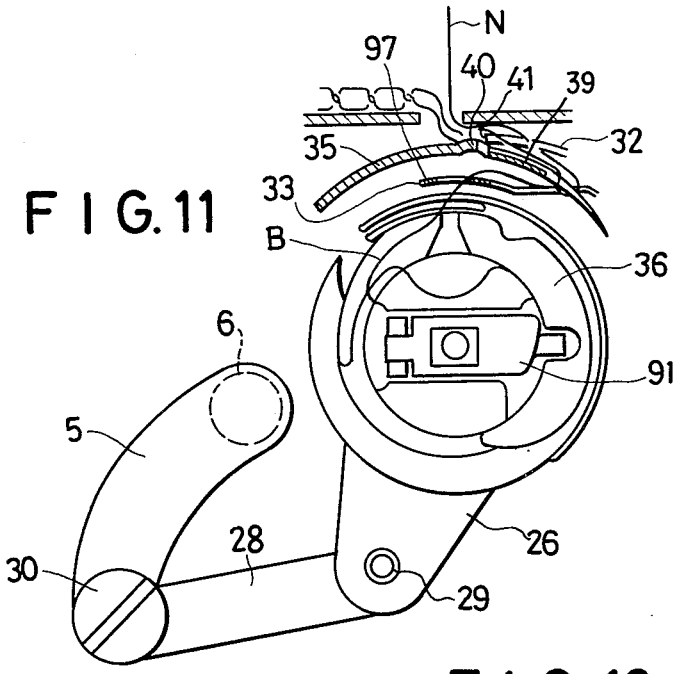
FIG. 11 is a view similar to FIG. 7, wherein, however, the timing is such that the thread cutter has just cut the thread.
Figure 12:
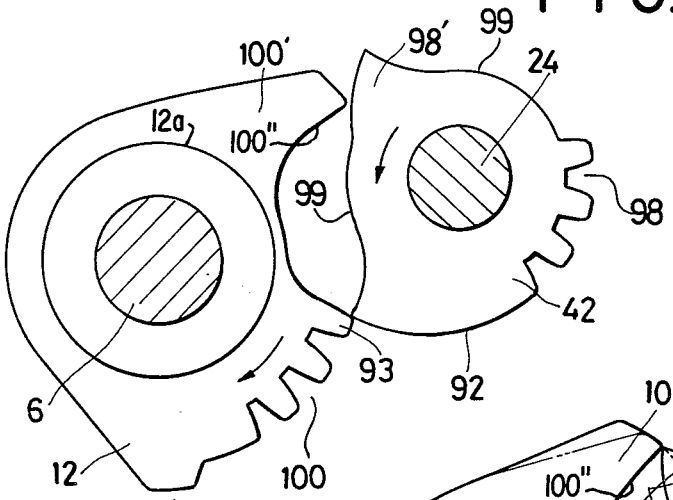
FIG. 12 is a view similar to FIG. 6, wherein, however, the timing corresponds to that in FIG. 1.
Figure 13:
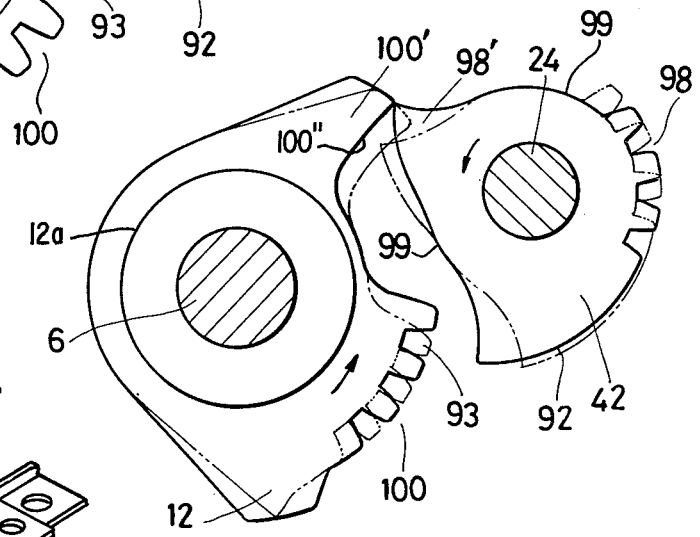
FIG. 13 is a view similar to FIG. 6, wherein, however, the timing is such that the thread catcher has begun to rotate in a direction reverse to the direction in which the catcher catches the sewing yarn.

In the design and arrangement of the thread trimming device according to this invention, such excess drawing-out of the upper thread N can be effectively avoided by bringing the gear teeth 98, 100 of the partial gears 12, 42, respectively, into mutual engagement so that the movable cutting edge 40 of the thread catcher 35 and the stationary cutting edge 41 of the stationary cutter blade 32 may be brought rapidly together directly after the arrival of the specific operational timing stage shown in FIG. 10. Accordingly, the occurrence of the thread trimming operation is brought as close as possible to the time of the upper dead point of the thread take-up lever. After it has reached the position shown in FIG. 10, the drive partial gear 42 rotates in such a way that the cam portion 92 formed in succession to the gear teeth 98 thereon keeps in sliding contact with the last one of the teeth 93 on the follower partial gear 12. By this operation, the cutting edges 40, 41 are brought into cooperation with each other, as shown in FIGS. 11 and 12, for simultaneous trimming of the threads N and B. Until the trimming job has been completed, the thread catcher 35 continues to pivot at a rather low speed due to the gradually increasing radius of curvature of the cam portion 92.

Upon execution of the thread trimming job and after further slight rotation of the driving partial gear 42, the engagement of cam portion 92 of the driving partial gear 42 and the gear tooth 93 on the follower partial gear 12 is released. After release of the follower partial gear 12, the thread catcher 35 pivots in the opposite direction under the resilient force of the coil spring 10 until the radial projection *7a* of the flange is brought into contact with stationary stop 11. Just after release of the engagement between the two partial gears 12 and 42, the radial projection 98' formed on the periphery of the driving partial gear 42 comes into contact with the radial projection 100' and the cam portion 100'' formed on the periphery of the follower partial gear 12. The engagement of the radial projection 98' with the radial projection 100' and the cam portion 100'' assists reverse swivel of the follower partial gear 12 as well as the thread catcher 35. After completion of this step, a known position sensor (not shown) acts to sense the upper stop position of the thread take-up lever, which is close to its upper dead point. When the position sensor senses that the thread take-up lever has reached its upper stop position, an electrical instruction signal for the interruption of electric current supply is delivered to the trimming solenoid 18. In this way, the follower partial gear 12, the arm member 15, and the plunger 19 are caused to return to their starting positions by the resilient resetting action provided by the coil spring 20.

Under these conditions, therefore, the thread trimming device is kept ineffective and ready for the next trimming operation when the sewing machine is caused to run for its next sewing job.

When the plunger 19 pushes the arm member 15 to the left in FIG. 1 for the execution of the thread trimming job, movement of the arm member 15 pulls the cable 22 to the left in FIG. 1. As previously explained, that motion of the cable 22 pivots the tension release lever 45, FIG. 4, thereby pushing the tension stud 49 towards the thread take-up disc unit 50 by means of cam surface 48 on the lever 45, resulting in the release of tension in the thread at the unit. Therefore, the thread N will be delivered from its supply source in a smooth manner after the thread take-up lever has begun its thread pull-up operation after successful catch of the upper thread N by the thread catcher 35, as schematically shown in FIG. 9.

After completion of the thread trimming job and upon interruption of current supply to solenoid 18, the tension release lever 45 will be caused to swivel in the opposite or counterclockwise direction in FIG. 4 under the action of return spring 51, so as to bring the thread take-up disc until 50 into its operating position for applying tension to the upper thread N.

What is claimed is:

1. A thread trimming device for a sewing machine, said device comprising:

(a) a first shaft rotably driven by the main shaft of the sewing machine;

(b) a first ratchet means disposed on said first shaft and rotable therewith, said first ratchet means comprising a first partial gear having:

(i) a first peripheral segment having teeth thereon;

(ii) a second peripheral segment having a first cam surface formed thereon adjacent to said first peripheral segment on one side thereof;

(iii) a third peripheral segment having a first radial projection formed thereon; and (iv) fourth and fifth peripheral segments having blank surfaces thereon disposed between said second and third peripheral segments and between said first and third peripheral segments, respectively;

(c) a stationary blade means fixably secured to the framework of the sewing machine;

(d) a second shaft disposed parallel to said first shaft;

(e) pivotably movable blade means operably connected to said second shaft;

(f) a second rachet means disposed on said second shaft and axially movable relative thereto so as to selectable engage said first rachet means, said second rachet means comprising a second partial gear having:

(i) a first peripheral segment having teeth thereon;

(ii) a second peripheral segment having a second radial projection formed thereon; and (iii) a third peripheral segment having a second cam surface formed thereon disposed between said first and second peripheral segments; and (g) electrically operable means for moving said second rachet means along said second shaft so as to engage said first rachet means, whereby:

(h) upon actuation of said electrically operable means, said teeth on said first and second partial gears engage each other to rotate said movable blade means to an operable position relative to said stationary blade means;

(i) thereafter, said first cam surface comes into sliding contact with a tooth on said first partial gear to slowly rotate said movable blade means to cooperate with said stationary blade means to perform the thread trimming operation; and (j) thereafter, said first radial projection comes into sliding contact with said second radial projection and said second cam surface to rotate said second rachet means in the direction opposite the direction in which it rotated during the thread trimming operation.

2. A thread trimming device as recited in claim 1 wherein said movable blade means comprises:

(a) a thread catching portion for drawing the lower thread out of a bobbin case in the sewing machine and for catching the lower thread to prepare it for the thread trimming operation and (b) a blade portion for cooperating with said stationary blade means to perform the thread trimming operation.

* * * * *